United States Patent [19]

Binder

[11] Patent Number: 5,067,177

[45] Date of Patent: Nov. 26, 1991

[54] CUFF-LIKE TUBULAR EXTENSIONS FOR WEARING APPAREL

[76] Inventor: Margaret L. Binder, 7334 Palmleaf La., Worthington, Ohio 43235

[21] Appl. No.: 525,409

[22] Filed: May 18, 1990

[51] Int. Cl.[5] ..... A41B 11/00; A41B 7/00

[52] U.S. Cl. ..... 2/239; 2/60; 2/61; 2/66; 2/170; 2/242; 2/DIG. 11

[58] Field of Search ..... 2/239, 160, 162, 170, 2/242, DIG. 11, 60, 61, 66

[56] References Cited

U.S. PATENT DOCUMENTS

| | | | |
|---|---|---|---|
| 743,625 | 11/1903 | Douglas | 2/242 |
| 815,998 | 3/1906 | Wolff | 2/60 |
| 1,746,485 | 2/1930 | Lynk | 2/61 |
| 2,418,887 | 4/1947 | Jones | 2/162 |
| 3,594,819 | 7/1971 | Mullins et al. | 2/170 |
| 4,675,915 | 6/1987 | Siciliano | 2/239 |

FOREIGN PATENT DOCUMENTS

| | | | |
|---|---|---|---|
| 208343 | 4/1940 | France | 2/242 |
| 982991 | 6/1951 | France | 2/239 |
| 1095791 | 3/1954 | France | 2/239 |
| 2457645 | 1/1981 | France | 2/239 |
| 283116 | 3/1931 | Italy | 2/239 |
| 337082 | 2/1936 | Italy | 2/239 |
| 494421 | 10/1938 | United Kingdom | 2/170 |

*Primary Examiner*—Werner H. Schroeder
*Assistant Examiner*—Gloria Hale
*Attorney, Agent, or Firm*—Robert E. Stebens

[57] ABSTRACT

An article of wearing apparel is provided having cuff-like elements of tubular configuration designed to be worn either on the lower portions of a persons's legs in combination with socks or on a person's arms in association with a sleeved garment such as a sweater to produce a decorative effect. The cuff-like elements are formed from a textile such as knitted or woven fabric exhibiting a resilient characteristic tending to cause them to constrict about the wearer's legs or arms and thereby be retained in position. Each of the cuff-like elements is of a relatively short length and is sized so that one marginal end portion will be capable of being projected a distance into either the end of a sweater sleeve or the upper cuff of a sock, either singly or in multiples disposed in series relationship, thereby creating a multiple cuff appearance. A plurality of the cuff-like elements may be interfitted with each other and worn independently of other apparel such as a retainer in securing of a person's hair into a ponytail. Decorative effects that can be achieved are multiplied by combining a plurality of the cuff-like elements in different colors.

2 Claims, 2 Drawing Sheets

CUFF-LIKE TUBULAR EXTENSIONS FOR WEARING APPAREL

FIELD OF THE INVENTION

This invention relates in general to an article of wearing apparel. It relates more particularly to an article of wearing apparel in the form of tubular elements of relatively short length formed from fabric materials designed to be placed on a person's leg or arm in either multiples to form a decorative article or to be used in combination with other articles of clothing such as socks or sleeved-type garments.

BACKGROUND OF THE INVENTION

Articles of wearing apparel such as socks such as those of the type commonly worn by young children or juveniles are formed with a foot section terminating in an ankle component which extends a distance upwardly over the person's ankle and lower portion of the leg. This ankle portion is commonly fabricated from fabric materials such as by knitting or weaving and some attempts have been made to enhance the decorative appearance of this ankle section. The socks are often formed in various colors to effect either complemental or contrasting color effects with other articles worn by the person. There have also been some attempts to modify the conventional weaving or knitting to introduce more pleasing visual appearance to the ankle section. Attempts have also been made by the persons wearing the socks to enhance their visual appearance by either turning the ankle section over onto itself to form an inverted cuff or to otherwise arrange the ankle section in various manners to provide a different visual appearance. However, either the techniques of fabrication or the decorative features incorporated through fabrication or the technique of fitting the sock on the ankle generally leave the overall impression of an ordinary tubular ankle section which encases the person's ankle and lower portion of the leg.

SUMMARY OF THE INVENTION

In accordance with this invention, a tubular element or separate cuff element is provided for utilization in combination with other components of wearing apparel such as a sock with an ankle section or with a sleeved-type garment. The tubular element or cuff element is provided as a separate component which is used in combination with the sock or sleeved garment resulting in a composite structure having a novel and pleasing aesthetic appearance. These cuff elements which may be fabricated from fabric materials of either knitted or woven construction are of relatively short lengths and are adapted to be positioned on the person's leg in adjacent relationship to the sock with a marginal end portion of the cuff element inserted into an upper marginal end portion of the sock's ankle section. When thus combined, the combination produces a novel and aesthetically pleasing appearance through a mock appearance of a sock having a plurality of ankle sections. Even greater variations in visual appearance are obtained with this combination of separate cuff elements and basic component of a sock through forming of the cuff element in a color different from that of the sock with which it is to be worn. Additionally, a plurality of the cuff elements in different colors may be combined in serial arrangement to each other and to the ankle section of the sock to produce further modified and creative decorative effects.

The cuff elements of this invention may also be combined with sleeves of garments to similarly produce a different decorative effect. When worn with the sleeve of a garment such as a sweater, the cuff elements may be of the same or a contrasting color and worn with an end portion inserted into the terminal end of the sweater sleeve to similarly create a novel and aesthetically pleasing appearance.

A plurality of the tubular cuff elements of this invention may also be combined to function as a retaining element for a person's hair such as in the formation of a ponytail. Again, the plurality of cuff elements may either be of the same color or they may be of different contrasting colors to produce various visual effects.

These and other objects and advantages of the tubular cuff elements of this invention in combination with other articles of wearing apparel will be readily apparent from the following detailed description of the embodiments thereof and the accompanying drawings.

DESCRIPTION OF THE DRAWING FIGURES

DESCRIPTION OF THE ILLUSTRATIVE EMBODIMENTS

Figure 1:
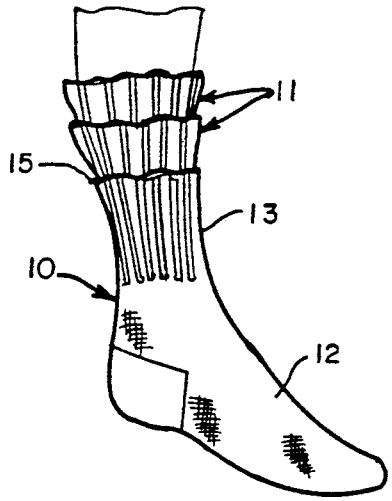
FIG. 1 is a side elevational view of a sock and a plurality of the cuff elements of this invention positioned in combination on a person's leg.

Referring to FIG. 1 of the drawings, the invention is shown as comprising the combination of a sock 10 and two of the tubular cuff elements 11. The sock 10 is of a generally conventional construction including a foot enclosing portion 12 and a tubular ankle section 13. A sock of this type is generally fabricated by knitting techniques, although other construction techniques may be employed. In the illustrative embodiment, the sock is shown as being of a construction wherein the upper portion of the ankle section 13 is formed with a plurality of ribs 14 extending axially thereof and of a specific construction and configuration to provide certain decorative appearance. It will be understood that the ankle section need not be formed with such ribs and may have an overall smooth appearance if so desired. Also, it will be noted that the extreme terminal end of the ankle section 13 is formed with a circumferentially extending ring 15 and which is given a "ruffled" treatment for additional decorative effect. Again, it will be understood that the sock ankle section need not be provided with such a decorative ring and can be merely terminated in a smooth end ring.

Utilization of a knitting technique to form at least the ankle section 13 has the advantage of developing a resilient characteristic. This resilient characteristic is of particular advantage in that with appropriate sizing of the ankle section, it will be expanded upon donning and thereby inherently result in constriction about the wearer's leg. This has advantage in that it aids in maintaining the ankle section 13 in a desired position on the wearer's leg. If greater constrictive effect is desired, elastic band elements (not shown) may be incorporated at desired locations.

Figure 3:
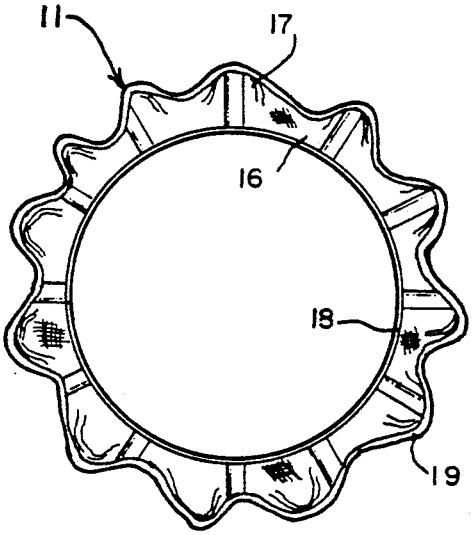
FIG. 3 is a top plan view of one of the cuff elements.
Figure 2:
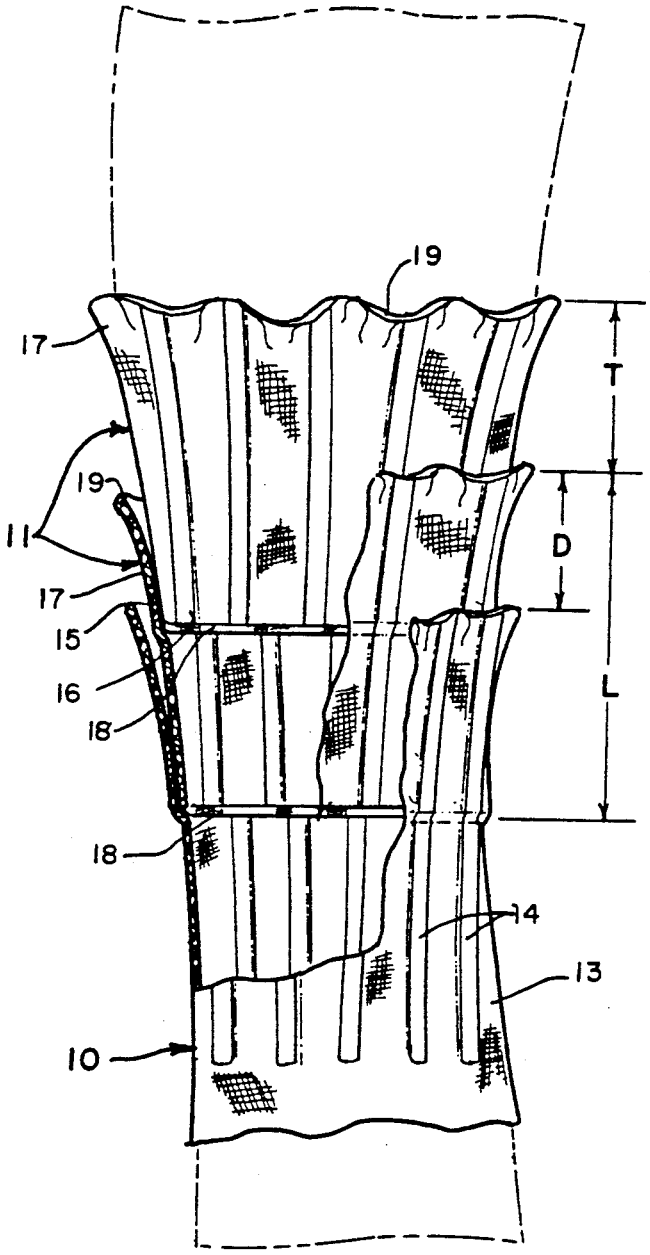
FIG. 2 is a fragmentary elevational view on a substantially enlarged scale of the upper end portion of the sock and a plurality of the cuff elements with portions thereof broken away for clarity of illustration.

Specifics of the structure and assembly of the cuff elements 11 and ankle section 13 of the sock 10 can be best seen in FIGS. 2 and 3. The two cuff elements 11 are shown as being of the same general configuration and dimension, although the cuff elements may be of different configurations and sizes depending upon the visual appearance effect that may be desired to be achieved. Regardless of the configuration and dimension, each of the cuff elements 11 is of elongated tubular construction having respective first and second marginal end portions 16 and 17, respectively, terminating in respective end rings 18 and 19. The first marginal end portion 16 is shown as being of straight-walled shape, whereas the second marginal end portion 17 is shown as having a ruffled appearance similar to that of the upper ring 15 of the sock's ankle section. It will be understood that this second marginal end portion 17 need not have the end ring 19 formed with such a ruffled configuration or that it may be provided with different configurations depending upon what visual effects are desired to be achieved.

Each of the cuff elements 11, as indicated, is fabricated by knitting techniques and through appropriate sizing, they will thus be caused to constrict about the wearer's leg and aid in maintaining of the cuff element in a desired position. Again, as in the case of the sock's ankle section 13, resilient elements in the nature of elastic bands (not shown) may be incorporated in the knitted structure if greater constrictive effect is desired.

A basic assembled configuration of the cuff elements with a sock is shown in FIG. 2 and it will be understood that the assembly may be varied from that which is illustrated. In FIG. 2, each of the two cuff elements 11 is shown having its first marginal end portion inserted within the next adjacent cuff element or upper portion of the sock's ankle section 13. The distance of insertion can be varied as between the cuff elements or the ankle section in accordance with the wearer's personal preferences and desires as to the visual effect desired to be achieved. For example, the portion of the cuff element 11 next adjacent the ankle section may have its exposed portion designated by the dimension D increased or decreased with respect to its total length portion L. Similarly, the exposed second marginal end portion 17 of the upper cuff element indicated by the dimension T may be different from the exposed portion D of the lower cuff element. Different visual appearances can thus be readily achieved through utilization of a plurality of the cuff elements. Also, while two cuff elements 11 are shown in association with a sock 10, it will be understood that more than two such elements may be utilized in combination or if desired, only one such cuff element may be used to achieve a particular visual effect.

Additional visual effects can be achieved through combining cuff elements and socks of different colors. Specifically, each of the cuff elements 11, when a plurality of such elements are employed, may be of different contrasting colors and perhaps also contrasting with respect to the sock. Alternatively, an upper cuff element may be of the same color as the sock with the intermediate cuff element being of a contrasting color to produce a particular visual appearance.

It will also be understood that the cuff elements 11 as well as the ankle section 13 of the sock need not be worn in the generally straight configuration as is shown in FIG. 2. For example, the upper marginal end portion of the ankle section 13 may be turned downwardly to form an inverted cuff if such is desired. Similarly, either or both of the cuff elements 11 may also have their upper or second marginal end portions turned downwardly into an inverted cuff arrangement if so desired. This inverted configuration is not illustrated as the technique is known and understood.

Figure 4:
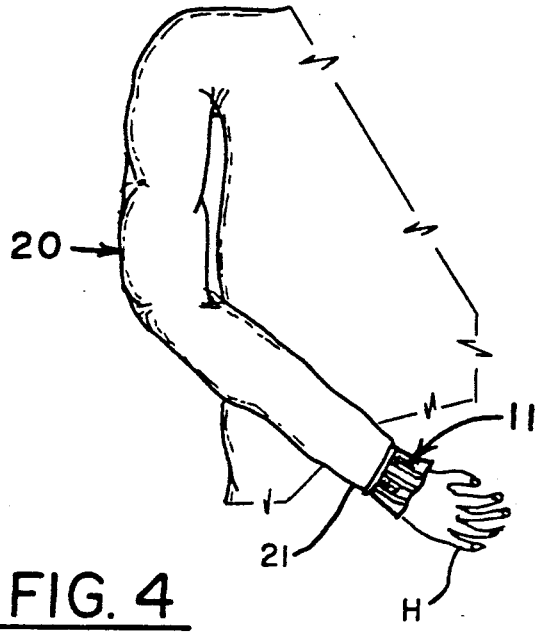
FIG. 4 is a side elevational view of the sleeve portion of a garment placed on a person's arm and in combination with a cuff element of this invention.

The utilization of cuff elements 11 formed in accordance with this invention in association or combination with other articles of wearing apparel is illustrated in FIG. 4. In that drawing figure, the lower sleeve portion of a garment designated generally by the numeral 20 is shown fitted onto a person's arm with the hand H extending outwardly from the terminal end portion 21 of the sleeve. Where the sleeve 20 of the garment is of a knitted-type fabric construction, the terminal end 21 will, in most cases, also tend to constrict around the person's arm in a manner similar to that of a knitted sock. In the illustrated combination, a single cuff element 11 is shown combined with the sleeve although it will be understood that two or more such cuff elements may be combined to achieve particular visual effects. The cuff element 11 as in the case with the sock in this basic combination has a first marginal end portion which is inserted into the terminal end 21 of the sleeve. Again, the cuff element may be of a contrasting color and its axial position with respect to the sleeve may be varied in accordance with personal preferences and visual effects.

Figure 5:
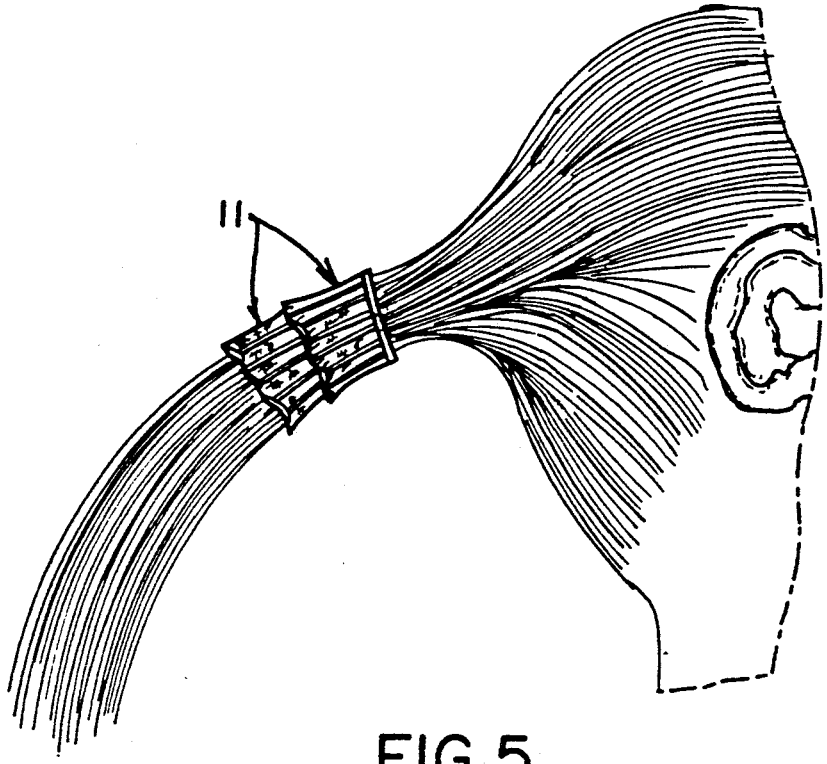
FIG. 5 is a side elevational view of a person's head showing the hair being retained by a plurality of the cuff elements.

Another use of the cuff elements 11 fabricated in accordance with this invention is diagrammatically illustrated in FIG. 5. In that drawing figure, two of the cuff elements 11 are shown assembled in axially aligned relationship for the purpose of functioning as a hair retainer and holding a strand of the person's hair in the form of a ponytail. The several cuff elements 11 may be of either the same color or they may be of contrasting colors and interfitted in different axial positions with respect to each other to obtain particular visual effects. The cuff elements 11 need not perform the actual holding function as they may be merely positioned on the strand of hair with an elastic band or other similar element concealed within one or the other of those cuff elements performing the actual retaining function.

It will be readily apparent that a particularly novel and unique article of wearing apparel is provided by this invention and which can be utilized in various manners to achieve specific desired visual effects. The combination of separate cuff elements in association with other types of wearing apparel creates unique visual appearances and can be readily modified by the wearer in accordance with personal desires. Also, the cuff elements may be utilized by themselves in combination to obtain other visual effects in the nature of wearing apparel.

Having thus described this invention, what is claimed is:

1. An article of wearing apparel comprising a sock having a foot portion for receiving a person's foot and an ankle portion of elongated tubular configuration connected with and extending from said foot portion having a marginal end portion open at a terminal end through which a person's leg extends, said marginal end portion sized to be in constrictive engagement with a person's leg extending therethrough, a cuff element of elongated, open-ended tubular configuration having first and second marginal end portions, said cuff element positionable on a person's leg in axially aligned relationship to said ankle portion with said cuff element's first marginal end portion projected a distance into the marginal end portion of said ankle portion with said second marginal end portion extending a distance axially outward from said ankle portion whereby it is exposed for visual observation, said cuff element's first marginal end portion sized to constrictively engage with the wearer's leg for retention thereon in substantially fixed position.

2. An article of wearing apparel according to claim 1 which includes a plurality of said cuff elements positionable on a person's leg in axially aligned relationship to each other with a first marginal end portion of each successive cuff element projected a distance into a marginal end portion of a preceding cuff element leaving a second marginal end portion thereof extending outwardly and exposed for visual observation.

* * * * *